US009863083B2

(12) United States Patent
Leibman et al.

(10) Patent No.: US 9,863,083 B2
(45) Date of Patent: Jan. 9, 2018

(54) DISPENSING SYSTEM UTILIZING MASS FLOW OF WATER

(71) Applicant: General Electric Company, Schenectady, NY (US)

(72) Inventors: Alexander Boris Leibman, Prospect, KY (US); Taranjeet Singh, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 453 days.

(21) Appl. No.: 14/461,586

(22) Filed: Aug. 18, 2014

(65) Prior Publication Data

US 2016/0047078 A1 Feb. 18, 2016

(51) Int. Cl.
*D06F 39/02* (2006.01)
*D06F 23/04* (2006.01)

(52) U.S. Cl.
CPC ..... *D06F 39/028* (2013.01); *D06F 23/04* (2013.01); *D06F 39/022* (2013.01)

(58) Field of Classification Search
CPC ..... D06F 39/028; D06F 23/04; D06F 39/022
See application file for complete search history.

(56) References Cited

U.S. PATENT DOCUMENTS

| | | | | |
|---|---|---|---|---|
| 3,033,427 | A * | 5/1962 | Petersen | D06F 39/022 137/263 |
| 3,359,764 | A * | 12/1967 | Faust | D06F 13/00 68/17 A |
| 3,696,970 | A * | 10/1972 | Bunnell | D06F 39/02 222/132 |
| 3,975,931 | A * | 8/1976 | Bischkopf | D06F 39/02 134/93 |
| 4,160,367 | A * | 7/1979 | Vona, Jr. | D06F 39/022 68/17 R |
| 5,582,039 | A * | 12/1996 | Mueller | D06F 37/12 68/17 R |
| 7,421,866 | B2 | 9/2008 | Kim | |
| 2005/0056060 | A1 | 3/2005 | Cenedese | |
| 2012/0017653 | A1* | 1/2012 | Doh | D06F 39/022 68/17 R |
| 2012/0180875 | A1* | 7/2012 | Keller | G05D 7/012 137/12 |

FOREIGN PATENT DOCUMENTS

JP H 08150289 6/1996

* cited by examiner

*Primary Examiner* — Michael Barr
*Assistant Examiner* — Benjamin L Osterhout
(74) *Attorney, Agent, or Firm* — Dority & Manning, P.A.

(57) ABSTRACT

A washing machine appliance and a method for operating a washing machine appliance are provided. The washing machine appliance includes one or more features for dispensing fluid additives using fewer valves. The method includes one or more steps for dispensing fluid additives using fewer valves.

11 Claims, 7 Drawing Sheets

DISPENSING SYSTEM UTILIZING MASS FLOW OF WATER

FIELD OF THE INVENTION

The subject matter of the present disclosure relates generally to washing machine appliances and methods of operating washing machine appliances.

BACKGROUND OF THE INVENTION

Washing machine appliances generally form wash and rinse fluids to clean clothing articles disposed within a wash basket of the appliance. The wash and rinse fluids can be formed in a wash tub of a washing machine appliance and can include water and various fluid additives such as, e.g., detergent, fabric softener, and/or bleach. To introduce one or more fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a washing machine appliance can include one or more compartments that receive fluid additives and direct the fluid additives into the wash tub.

The fluid additive contained in a compartment is flushed from the compartment into the wash tub of the appliance through an influx of water into the compartment. Usually, each fluid additive is directed to the wash tub at a different point in the cleaning cycle, requiring a valve for each compartment to dispense fluid additives to the wash tub. For washing machine appliances having multiple compartments for receiving fluid additives, the cost and complexity of such appliances is increased because multiple water valves are required.

Accordingly, a washing machine appliance having fewer valves for dispensing fluid additives to the wash tub of the washing machine appliance would be useful. More particularly, a washing machine appliance having a one water valve to provide water to more than one fluid additive compartment would be beneficial. In addition, a method for operating a washing machine appliance to dispense fluid additives to a wash tub of the washing machine appliance using fewer valves would be advantageous.

BRIEF DESCRIPTION OF THE INVENTION

The present subject matter provides a washing machine appliance and a method for operating a washing machine appliance. The washing machine appliance includes one or more features for dispensing fluid additives using fewer valves. The method includes one or more steps for dispensing fluid additives using fewer valves. Additional aspects and advantages of the invention will be set forth in part in the following description, or may be apparent from the description, or may be learned through practice of the invention.

In a first exemplary embodiment, a washing machine appliance is provided. The washing machine appliance defines a vertical direction and includes a cabinet; a wash tub located within the cabinet; a wash basket rotatably mounted within the wash tub; and a fluid additive dispenser. The fluid additive dispenser includes a first compartment configured for receipt of a fluid additive. The first compartment has a first outlet and a first opening to provide fluid to the wash basket. The fluid additive dispenser also includes a second compartment configured for receipt of a fluid additive; the second compartment has a second outlet and a second opening to provide fluid to the wash basket. Further, the fluid additive dispenser includes a third opening; the third opening allows fluid communication between the first compartment and the second compartment. The washing machine appliance also includes a valve manifold having a first valve configured to provide water to the wash basket and a second valve configured to provide water to the fluid additive dispenser.

In a second exemplary embodiment, a washing machine appliance is provided. The washing machine appliance defines a vertical direction and includes a cabinet; a wash tub located within the cabinet; and a wash basket rotatably mounted within the wash tub. The washing machine appliance also includes a first compartment configured for the receipt of a fluid additive. The first compartment has a first outlet and a first opening to provide fluid to the wash basket. The washing machine appliance further includes a second compartment configured for the receipt of a fluid additive. The second compartment is adjacent the first compartment and has a second outlet and a second opening to provide fluid to the wash basket. The washing machine appliance also includes a third opening defined between the first compartment and the second compartment to allow fluid communication between the first compartment and the second compartment; a first valve configured to provide water to the wash basket; and a second valve configured to provide water to the first and second compartments.

In a third exemplary embodiment, a method for operating a washing machine appliance is provided. The washing machine appliance comprises a first valve for providing water to a wash tub and a second valve for providing water to a first compartment configured to receive a fluid additive, the first compartment having an opening for the flow-through of fluid to a second compartment, the first compartment also having a first outlet, the second compartment having a second outlet. The method comprises the steps of opening the first valve; actuating, at a predetermined time $t_1$, the second valve to establish a flow of water through both the first valve and the second valve, the flow of water through the second valve to the first compartment sufficient to cause fluid to exit from the first compartment through the outlet; closing the first and second valves at a predetermined time $t_2$; establishing, at a predetermined time $t_3$, a flow of water through the second valve, the flow of water through the second valve to the first compartment sufficient to cause fluid to exit from the first compartment through the first outlet, to overflow from the first compartment to the second compartment through the opening, and to exit from the second compartment through the second outlet; and shutting the second valve.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same reference numerals in different figures denotes the same or similar features.

DETAILED DESCRIPTION

Figure 1:
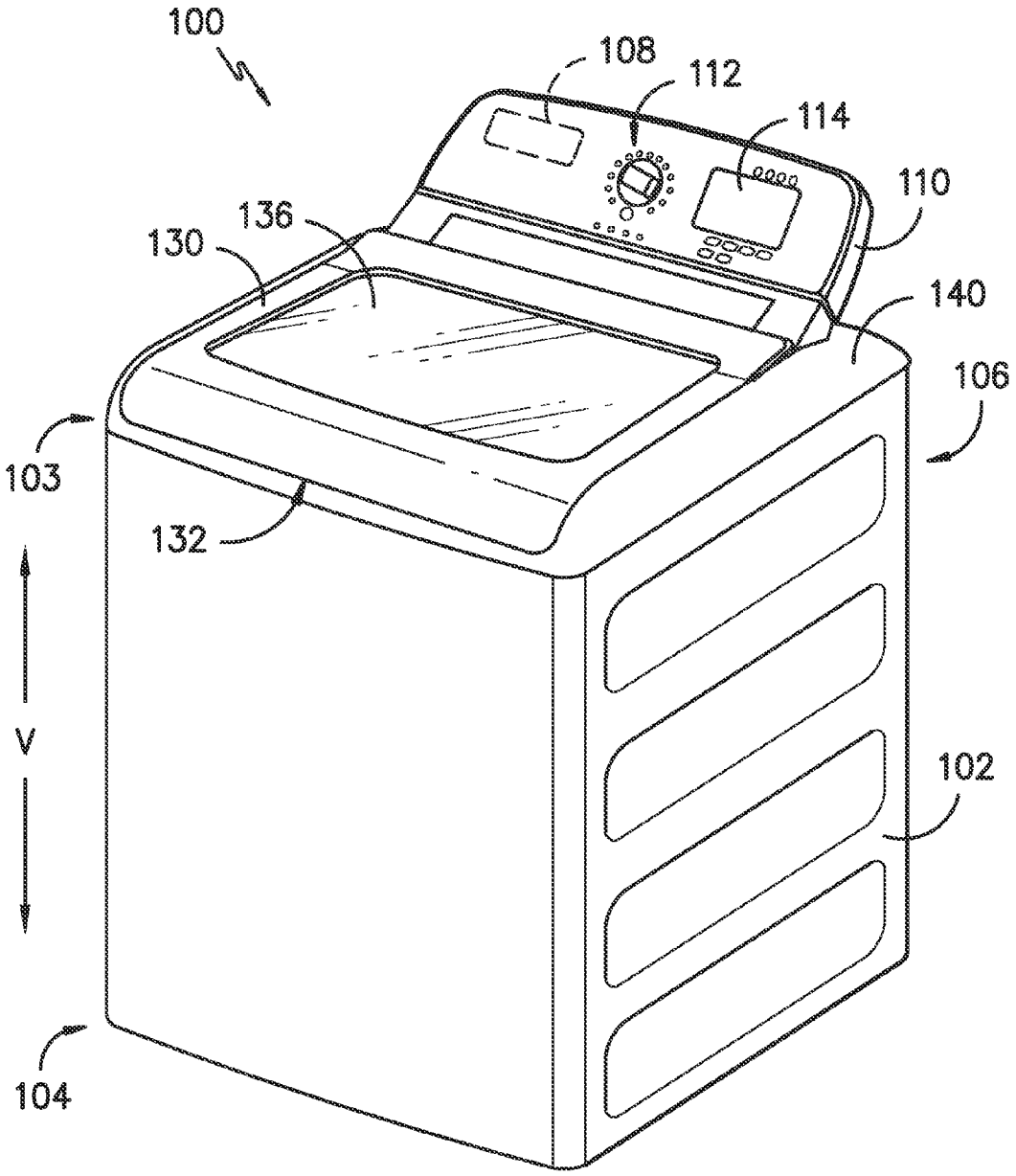
FIG. 1 illustrates an exemplary embodiment of a washing machine appliance of the present invention with a door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
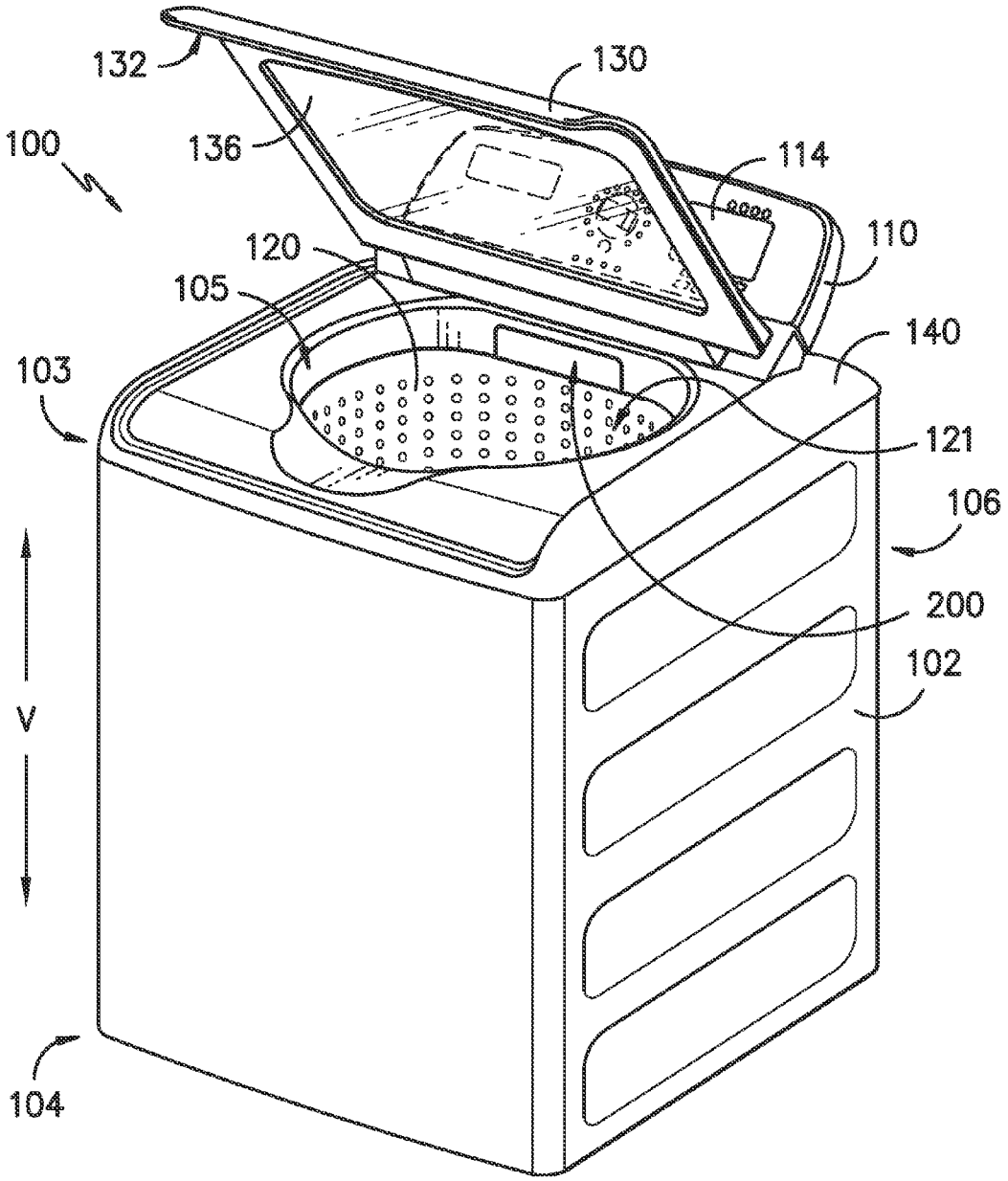
FIG. 2 illustrates the exemplary embodiment of a washing machine shown in FIG. 1 except with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any outer suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

Top panel 140 includes at least one fluid additive dispenser 200 (FIG. 2) for receipt of one or more fluid additives, e.g., detergent, fabric softener, and/or bleach. While only one fluid dispenser will be described herein, it will be understood that multiple fluid additive dispensers may be used in alternative embodiments of the invention. Fluid additive dispenser 200 is positioned near wash tub 121; in FIG. 2, dispenser 200 is depicted at a vertical position above wash tub 121 near back panel 106 of cabinet 102, but dispenser 200 could be positioned in other locations as well. Fluid additive dispenser 200 is described in greater detail below.

Figure 4:
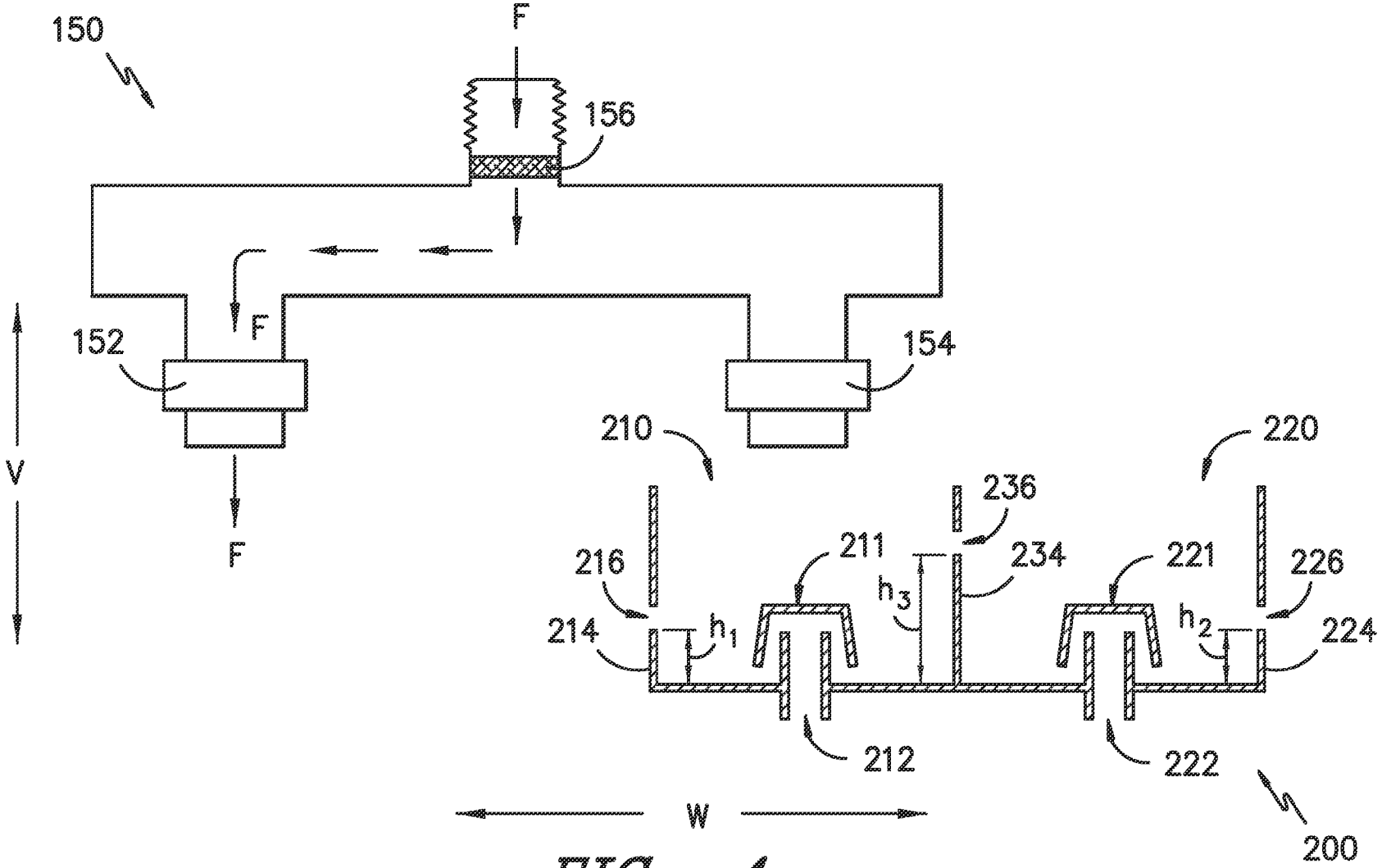
FIG. 4 is a schematic view of a fluid additive dispenser system incorporating the fluid additive dispenser of FIG. 3 within a washing machine appliance, illustrating an exemplary fluid flow path within the system.
Figure 5:
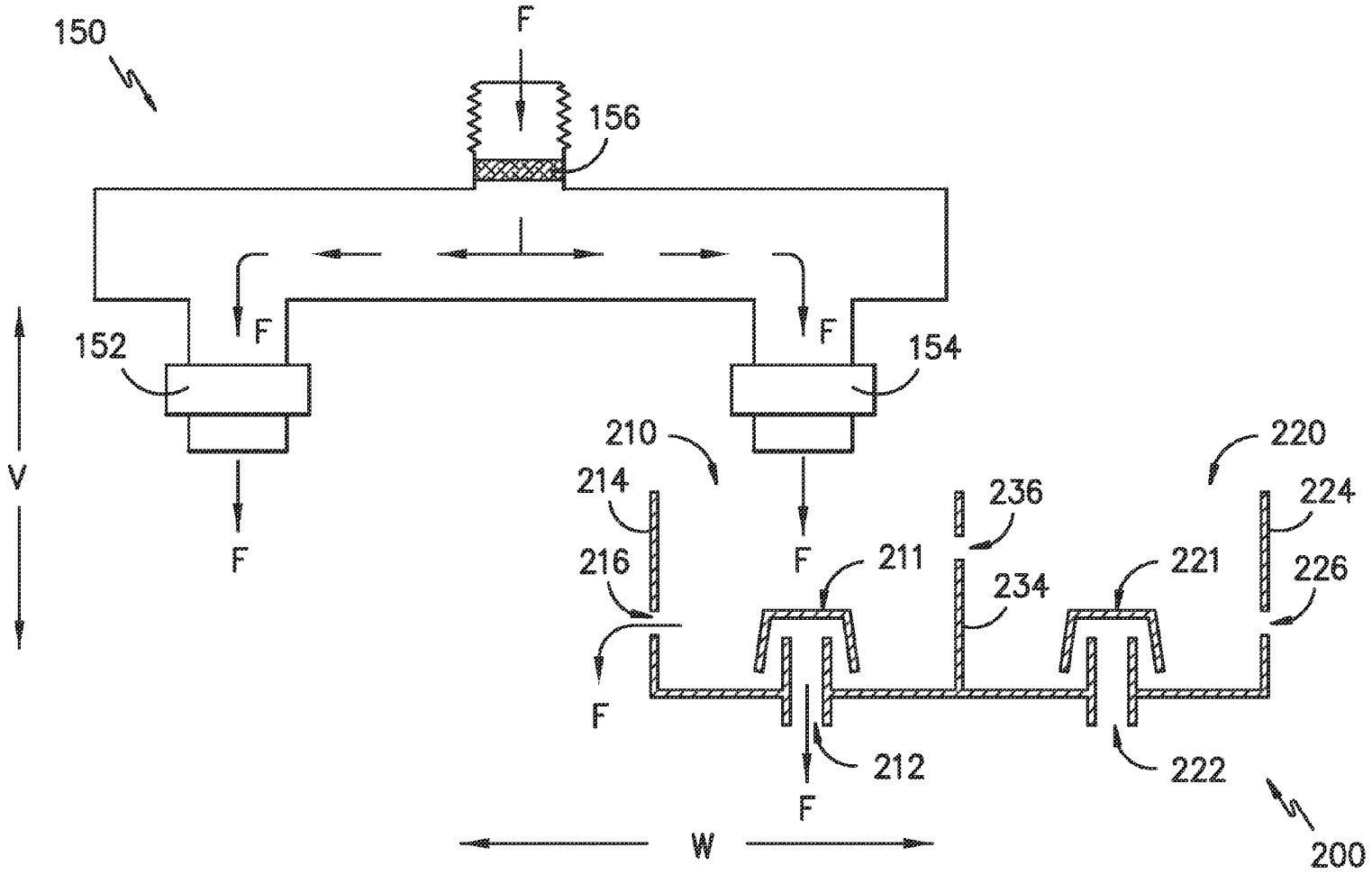
FIG. 5 is a schematic view of the fluid additive dispenser system within a washing machine appliance shown in FIG. 4, illustrating another exemplary fluid flow path within the system.
Figure 6:
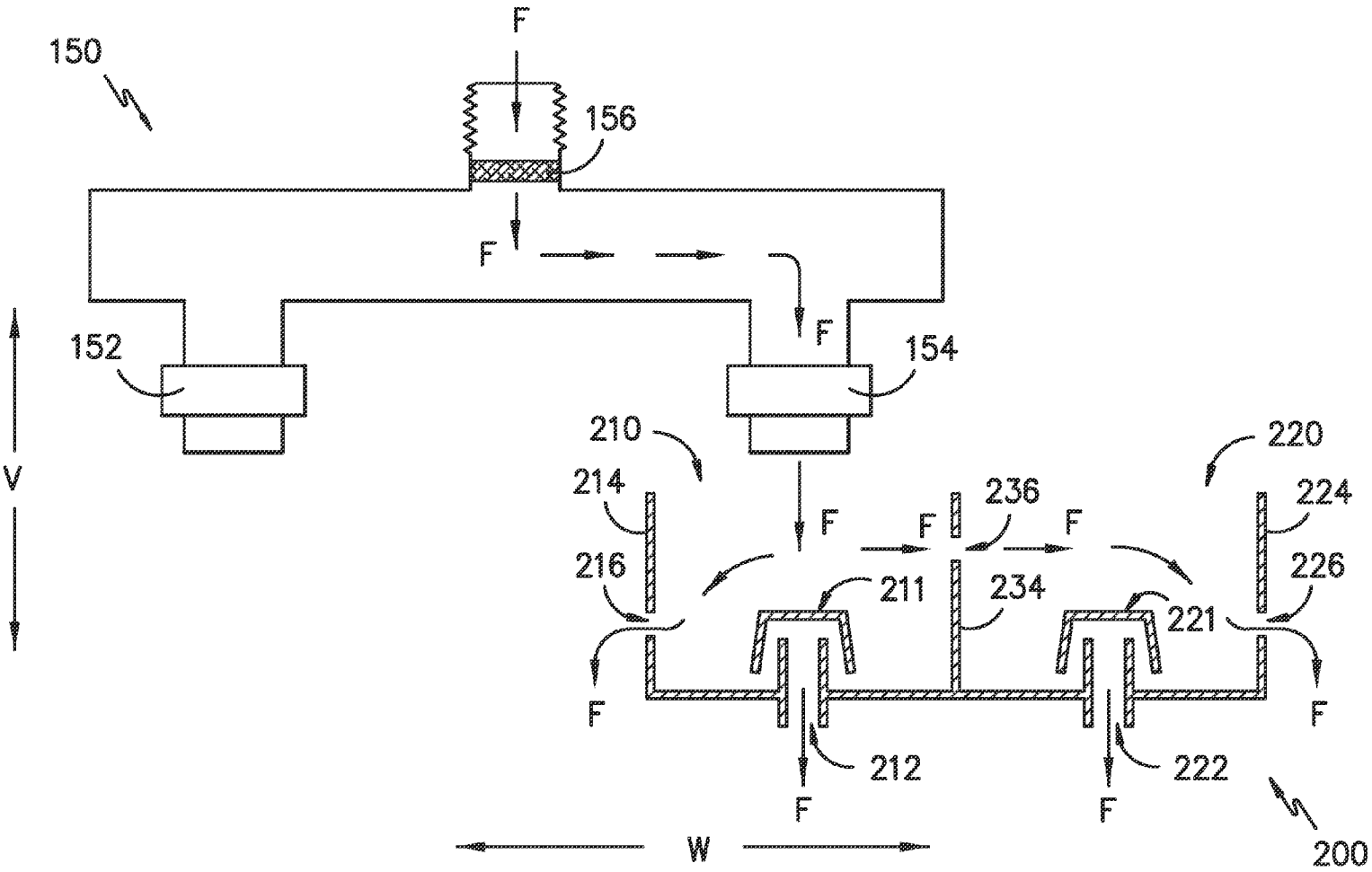
FIG. 6 is a schematic view of a fluid additive dispenser system within a washing machine appliance shown in FIG. 4, illustrating another exemplary fluid flow path within the system.

In an illustrative embodiment, laundry items are loaded into wash basket 120 through opening 105, and washing operation is initiated through operator manipulation of input selectors 112. Wash basket 120 is filled with water and detergent and/or other fluid additives from, e.g., dispenser 200, to form wash and rinse fluids. As shown in FIGS. 4, 5, and 6, one or more valves can be arranged in a valve manifold 150 and controlled by washing machine appliance 100 to provide for filling wash basket 120 with fluid to the appropriate level for the amount of articles being washed and/or rinsed.

In the illustrated exemplary embodiment of FIGS. 4, 5, and 6, valve manifold 150 includes first valve 152 and second valve 154. First valve 152 controls the flow of water to wash basket 120, and second valve 154 controls the flow of water to fluid additive dispenser 200. In this way, wash basket 120 can be filled with water and/or a mixture of water and fluid additive. Further, a flow limiter 156, through which the flow rate of water is restricted, is disposed upstream of valves 152, 154. By using flow limiter 156, the flow rate of water supplied to valves 152, 154 may be regulated such that a known flow rate is supplied to valves 152, 154. That is, even if the flow rate of water to valve manifold 150 is unknown, the flow rate of water supplied to valves 152, 154 from flow limiter 156 may be known. Thus, without knowing the flow rate of water supplied to valve manifold 150, systems downstream of flow limiter 156, such as fluid additive dispenser 200, can be designed based on the known flow rate of water from flow limiter 156. In alternative embodiments, washing machine appliance 100 may include one or more valves for supplying water to wash basket 120, fluid additive dispenser 200, and/or other components without valve manifold 150.

By way of example for a wash mode, once wash basket 120 is properly filled with fluid, the contents of wash basket 120 can be agitated (e.g., with an impeller as discussed previously) for washing of laundry items in wash basket 120. After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

While described in the context of a specific embodiment of washing machine appliance 100, using the teachings disclosed herein it will be understood that washing machine appliance 100 is provided by way of example only. Other washing machine appliances having different configurations (such as horizontal-axis washing machine appliances), different appearances, and/or different features may be utilized with the present subject matter as well.

Figure 3:
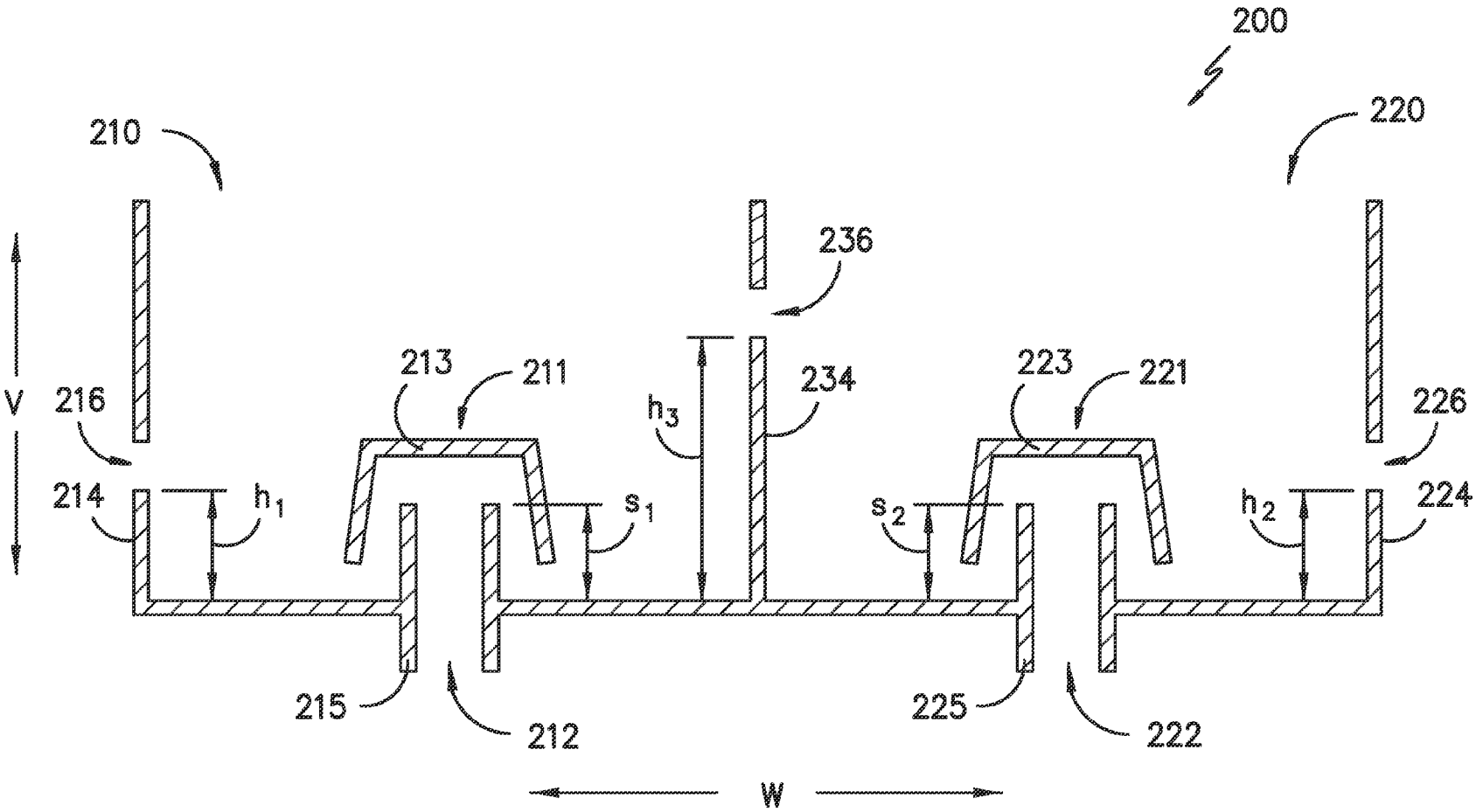
FIG. 3 is a cross-sectional view of an exemplary embodiment of a fluid additive dispenser of the present subject matter.

FIG. 3 illustrates an exemplary embodiment of fluid additive dispenser 200. As shown, dispenser 200 includes a first compartment 210 and a second compartment 220 for receiving one or more fluid additives defined along a width direction W. In alternative embodiments, fluid additive dispenser 200 may include a different number of compartments, e.g., one, three, or more than three compartments, and/or a different arrangement of compartments for the receipt of one or more fluid additives.

First compartment 210 includes a first wall portion 214 extending along the vertical direction V, and second compartment 220 includes a second wall portion 224 extending along the vertical direction V. First and second compartments 210, 220 also have a common wall portion 234 extending along vertical direction V. In addition, first compartment 210 includes a first opening 216 defined in first wall portion 214 at a vertical height $h_1$. Similarly, second compartment 220 includes a second opening 226 defined in second wall portion 224 at a vertical height $h_2$. A third opening 236 is defined in common wall portion 234 at a vertical height $h_3$. As shown, third opening 236 is positioned at a vertical distance above first opening 216 and second opening 226, i.e., $h_3$ is greater than $h_1$ and $h_2$. Height $h_1$ may be the same as height $h_2$, or one of height $h_1$ and $h_2$ may be greater than the other. In alternative embodiments, first opening 216, second opening 226, and third opening 236 may be positioned in other locations.

Further, first compartment 210 includes a first outlet 212, and second compartment 220 includes a second outlet 222. First compartment 210 and second compartment 220 are in fluid communication with wash basket 120 through first outlet 212 and second outlet 222 such that a mixture of water and fluid additive may be conveyed from the respective compartment 210, 220 to wash basket 120. Moreover, in the illustrated embodiment, first outlet 212 is configured as a siphon 211 and second outlet 222 is configured as siphon 221, such that, when water is introduced into a respective compartment 210, 220 and mixes with a fluid additive in the compartment, the mixture of water and fluid additive is siphoned from the compartment through the respective siphon 211, 221. Similarly, if water is introduced into a compartment 210, 220 and a fluid additive is not contained in the compartment, the water may be siphoned through the respective siphon 211, 221. As shown, siphon 211 includes a cap 213 and a tube 215; similarly, siphon 221 includes a cap 223 and a tube 225. The top of tube 215 is at a vertical height $s_1$ from the bottom of first compartment 210, and the top of tube 225 is at a vertical height $s_2$ from the bottom of second compartment 220. Height $s_1$ is less than heights $h_1$ and $h_3$, and height $s_2$ is less than heights $h_2$ and $h_3$. Heights $s_1$, $s_2$ may be the same, or one of height $s_1$ and $s_2$ may be greater than the other. Other configurations of outlets 212, 222 may be used as well.

FIGS. 4, 5, and 6 illustrate how the flow of fluid through a portion of the exemplary embodiment of washing machine 100 may be controlled by valves 152, 154. In FIG. 4, first valve 152 is open and second valve 154 is closed, such that the entire fluid flow through flow limiter 156 exits valve manifold 150 through first valve 152. That is, the flow rate of fluid through first valve 152 is the same as the flow rate of fluid exiting flow limiter 156. As an example, if flow limiter 156 limits the flow rate of water from the water supply through valve manifold 150 to about three gallons per minute, when second valve 154 is closed and first valve 152 is open, the flow rate of fluid through first valve 152 is about three gallons per minute. As discussed above, first valve 152 may be a fill valve to control the flow of water to wash basket 120 to fill wash tub 121 for, e.g., wash and rinse cycles of washing machine appliance 100.

In FIG. 5, both first valve 152 and second valve 154 are open, such that half of the fluid flow from flow limiter 156 is through first valve 152 and half of the fluid flow from flow limiter 156 is through second valve 154. That is, the flow rate of fluid through first valve 152 is half the flow rate of fluid exiting flow limiter 156, and the flow rate of fluid through second valve 154 is half the flow rate of fluid exiting flow limiter 156. Continuing with the above example, if flow limiter 156 limits the flow rate of water from the water supply through valve manifold 150 to about three gallons per minute, when both first valve 152 and second valve 154 are open, the flow rate of fluid through first valve 152 is about 1.5 gallons per minute and the flow rate of fluid through second valve 154 is about 1.5 gallons per minute.

As discussed above, second valve 154 may control the flow of water to fluid additive dispenser 200. In the illustrated exemplary embodiment, the flow of water through second valve 154 flows to first compartment 210. If first compartment 210 contains a fluid additive, when water flows through second valve 154 to first compartment 210, a mixture of water and fluid additive is formed in first compartment 210. The mixture of water and fluid additive exits first compartment 210 through first outlet 212 and first opening 216. As shown in FIG. 5, for this example the flow rate of fluid to first compartment 210 is not great enough to cause fluid to flow through third opening 236 to second compartment 220. That is, flow limiter 156 is sized such that, when both first valve 152 and second valve 154 are open, the flow rate of fluid to first compartment 210 is sufficient to flush any fluid additive that may be contained in first compartment 210 from the compartment through first outlet 212 and first opening 216 but is not great enough for fluid to overflow to second compartment 220 through third opening 236.

In FIG. 6, second valve 154 is open and first valve 152 is closed, such that the entire fluid flow through flow limiter 156 exits valve manifold 150 through second valve 154. That is, the flow rate of fluid through second valve 154 is the same as the flow rate of fluid exiting flow limiter 156. Continuing with the previous example, if flow limiter 156 limits the flow rate of water from the water supply through valve manifold 150 to about three gallons per minute, when first valve 152 is closed and second valve 154 is open, the flow rate of fluid through second valve 154 is about three gallons per minute.

As illustrated, second valve 154 may control the flow of water to fluid additive dispenser 200 such that the flow of water through second valve 154 flows to first compartment 210. If any fluid additive is contained in first compartment 210, a mixture of water and fluid additive exits first compartment 210 through first outlet 212 and first opening 216. However, unlike in FIG. 5, when only second valve 154 is open, the flow rate in this example is great enough to cause fluid to flow from first compartment 210 to second compartment 220 through third opening 236. That is, flow limiter 156 is sized such that the flow provided to first compartment 210 when only second valve 154 is open is at least a minimum flow rate required for a flow of fluid to exit first compartment 210 through first outlet 212 and first opening 216, as well as overflow to second compartment 220 through third opening 236 and to exit second compartment 220 through second outlet 222 and second opening 226. Thus, if a fluid additive is contained in second compartment 220, the fluid overflowing from first compartment 210 may mix with the fluid additive in second compartment 220 and exit second compartment 220 through second outlet 222 and second opening 226.

Accordingly, instead of using one valve to supply water to each fluid additive compartment, one valve may be used to supply water to multiple fluid additive compartments to flush the fluid additive from the respective compartment and to the wash basket to form wash and/or rinse fluids. In this way, the cost and complexity of including a valve associated with each fluid additive compartment can be avoided.

Moreover, it will be easily understood that, while second valve 154 is described above as positioned such that the flow of fluid from second valve 154 is provided to first compartment 210, in alternative embodiments, the flow of fluid from second valve 154 could be provided to second compartment 220. In still other embodiments, washing machine appliance 100 may include more than two fluid additive compartments, and one or more valves may be associated with the multiple fluid additive compartments. Other configurations of valves and fluid additive compartments may be used as well.

Figure 7:
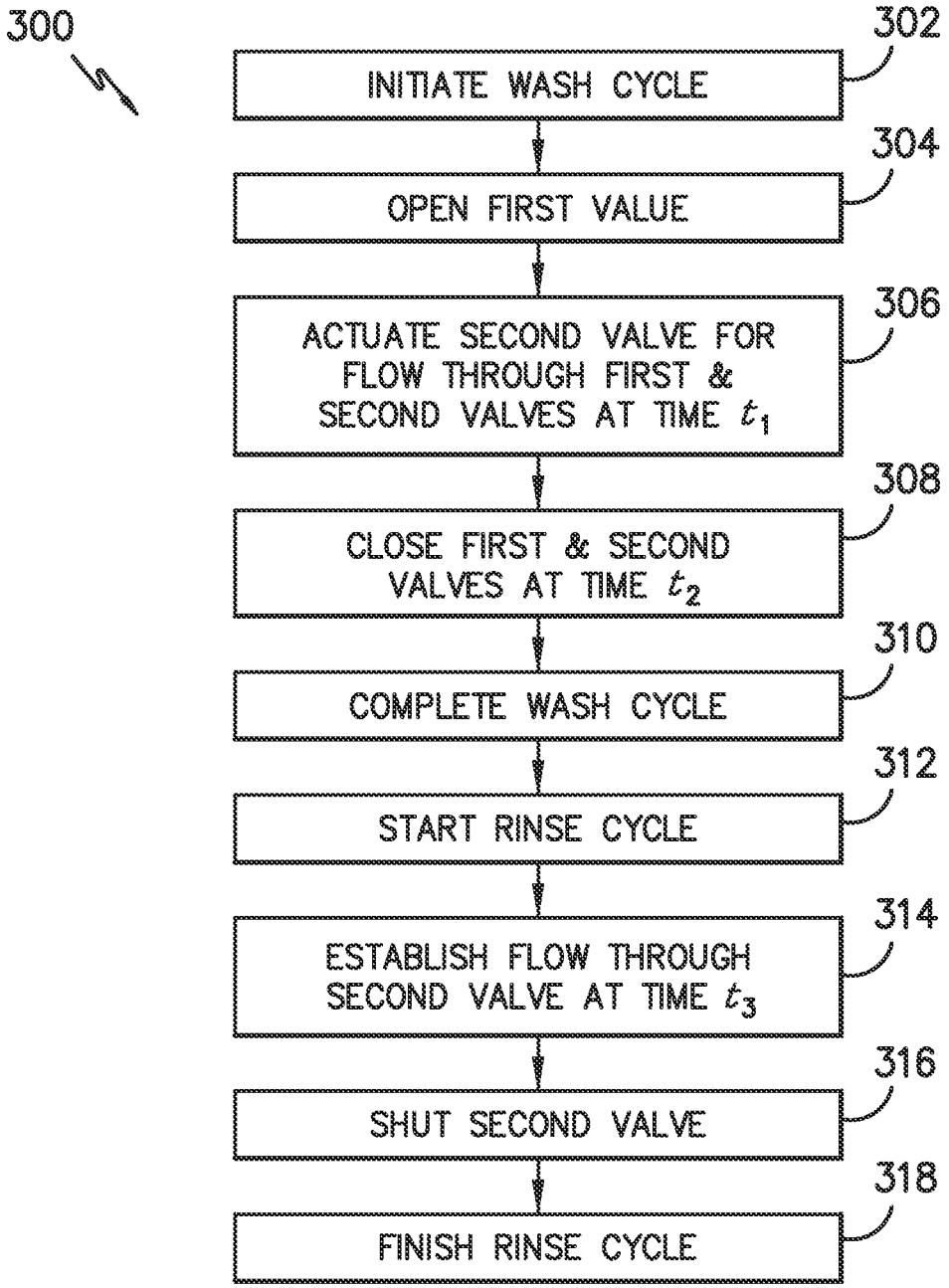
FIG. 7 provides a chart illustrating an exemplary method of operating a washing machine appliance according to the present subject matter.

FIG. 7 illustrates an exemplary method 300 of operating washing machine appliance 100. As described above, washing machine appliance 100 may include first valve 152 for providing water to the wash tub 121 and second valve 154 for providing water to first compartment 210. At step 302 of method 300, a wash cycle of washing machine appliance 100 is initiated, and at step 304, first valve 152 is opened, e.g., to fill wash tub 121 to form a wash fluid for washing laundry articles in wash basket 120. At step 306, second valve 154 is actuated, at a predetermined time $t_1$, to establish a flow of water through both first and second valves 152, 154 such that the flow through second valve 154 is sufficient to flush a fluid additive from first compartment 210 through first outlet 212 and first opening 216 but is not sufficient to overflow first compartment 210 through third opening 236. That is, if a fluid additive is contained in first compartment 210, a mixture of water and fluid additive may exit first compartment 210 through first outlet 212 and first opening 216. If first compartment 210 does not contain a fluid additive, the water entering first compartment 210 from second valve 154 may exit first compartment 210 through first outlet 212 and first opening 216.

As illustrated at step 308, first and second valves 152, 154 are closed at a predetermined time $t_2$, and the wash cycle is completed at step 310. In alternative embodiments, second valve 154 may be closed at time $t_2$ and first valve 152 may be closed after second valve 154 is closed. Thus, predetermined time $t_2$ may be based on a time sufficient to flush a fluid additive from first compartment 210, i.e., time $t_2$ may be selected such that first and second valves 152, 154 are both open for a sufficient time for a fluid additive to be flushed from first compartment 210 by the flow from second valve 154.

Next, at step 312, a rinse cycle of washing machine appliance 100 is started. At a predetermined time $t_3$, a flow of water is established through second valve 154, as shown at step 314. The flow of water through second valve 154 is sufficient to cause fluid to exit from first compartment 210 through first outlet 212 and first opening 216, to overflow from first compartment 210 to second compartment 220 through third opening 236, and to exit second compartment 220 through second outlet 222 and second opening 226. Thus, if first compartment 210 does not contain a fluid additive, when second valve is opened at step 314, water flows from first compartment 210 through first outlet 212, first opening 216, and third opening 236. The water flowing from first compartment 210 through third opening 236 enters second compartment 220. If a fluid additive is contained in second compartment 220, the water forms a mixture with the fluid additive, and the mixture of water and fluid additive may exit second compartment 220 through second outlet 222 and second opening 226. If a fluid additive is not contained in second compartment 220, the water entering through third opening 236 may exit second compartment 220 through second outlet 222 and second opening 226.

Second valve 154 is shut at step 316, and then at step 318, the rinse cycle is finished. Second valve 154 may be shut at a predetermined time $t_4$ that may be based on a sufficient amount of time after second valve 154 was opened at step 314 to flush any fluid additive contained in second compartment 220 from the compartment. That is, time $t_4$ may be selected such that only second valve 154 is open for a sufficient time for a fluid additive to be flushed from second compartment 220 by the flow from second valve 154. Further, in some embodiments, first valve 152 may be opened before or after second valve 154 is shut to provide water to form a rinse fluid. In such embodiments where first valve 152 is opened before second valve 154 is shut, first valve 152 may be opened at or after time $t_4$, where time $t_4$ is selected based on a sufficient amount of time to flush any fluid additive contained in second compartment 220 from the compartment when only second valve 154 is open.

Although described for embodiments of washing machine appliance 100 where second valve 154 provides water to first compartment 210, in alternative embodiments, second valve 154 may be positioned to provide a flow of water to second compartment 220. In such embodiments, when second valve 154 is actuated at step 306 of method 300, water flows to second compartment 220 and either water or a mixture of water and fluid additive may exit second compartment 220 through second valve 222 and second opening 226. Further, for such embodiments, when a flow of water is established through second valve 154 at step 314, water or a mixture of water and any fluid additive in second compartment 220 may exit second compartment 220 through second outlet 222 and second opening 226, and fluid may enter first compartment 210 by overflowing second compartment 220 through third opening 236. If a fluid additive is contained in first compartment 210, the fluid overflowing from second compartment 220 may mix with the fluid additive, and the mixture may exit first compartment 210 through first outlet 212 and first opening 216.

Additionally, predetermined times $t_1$, $t_2$, $t_3$, and $t_4$ may be based on any suitable period of time for dispensing fluid additives to wash basket 120 to form wash and/or rinse fluids. In certain embodiments, at step 302 of method 300, a device such as, e.g., controller 108 may start counting the time elapsed since the wash cycle was initiated. Then, in such embodiments, second valve 154 may be actuated at step 306 at a predetermined time $t_1$ from the initiation of the wash cycle; first and second valves 152, 154 may be closed at step 308 at a predetermined time $t_2$ from the initiation of the wash cycle, such that $t_2$ is greater than $t_1$; at step 314, a flow of water may be established through second valve 154 at a predetermined time $t_3$ from the initiation of the wash cycle, such that $t_3$ is greater than $t_2$; and at step 316, second valve 154 may be closed at a predetermined time $t_4$ from the initiation of the wash cycle, such that $t_4$ is greater than $t_3$. In other embodiments, times $t_1$, $t_2$, $t_3$, and $t_4$ may be measured from other events, e.g., time $t_1$ may be measured from when first valve 152 is opened at step 304, time $t_2$ may be measured from when second valve 154 is actuated at step 306, time $t_3$ may be measured from when the rinse cycle is initiated at step 312, and time $t_4$ may be measured from when a flow is established through second valve 154 at step 314. Other ways of measuring times $t_1$, $t_2$, $t_3$, and $t_4$ may also be used.

Further, other sequences of opening first valve 152 and second valve 154 may be used as well. For example, after a wash cycle is initiated, first valve 152 and second valve 154 may be opened simultaneously, and both valves may remain open for a certain period of time, or until a certain volume of fluid has been dispensed to wash tub 121. Then, second valve 154 may be closed and first valve 152 may remain open for a certain period of time or until a certain additional volume of fluid has been dispensed to wash tub 121. Alternatively, first and second valves 152, 154 may be closed simultaneously. Next, after a rinse cycle has been initiated, second valve 154 may be opened for a certain period of time or until a certain volume of fluid has been dispensed to wash tub 121. Then, second valve 154 may be closed and first valve 152 may be opened, or first valve 152 may be opened such that both valves are open. In other embodiments, second valve 154 may be closed and both second valve 154 and first valve 152 may remain closed until the method begins again, or until first valve 152 and/or second valve 154 are used according to another method. Other sequences are also possible.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, the washing machine appliance comprising:

a cabinet;

a wash tub located within the cabinet;

a wash basket rotatably mounted within the wash tub;

a first compartment configured for the receipt of a fluid additive, the first compartment having a first wall portion extending along the vertical direction from a bottom of the first compartment, a first opening defined in the first wall portion to provide fluid to the wash basket, and a first outlet defined in the bottom of the first compartment to provide fluid to the wash basket;

a second compartment configured for the receipt of a fluid additive, the second compartment adjacent the first compartment, the second compartment having a second wall portion extending along the vertical direction from a bottom of the second compartment, a second opening defined in the second wall portion to provide fluid to the wash basket, and a second outlet defined in the bottom of the second compartment to provide fluid to the wash basket;

a third opening defined between the first compartment and the second compartment to allow fluid communication between the first compartment and the second compartment;

a first valve configured to provide water to the wash basket; and a second valve configured to provide water to the first and second compartments, wherein the first and second compartments have at least one wall portion extending along the vertical direction that is a common wall portion to both the first and second compartments, and wherein the third opening is defined in the common wall portion at a vertical distance above both the first and second openings.

2. The washing machine appliance of claim 1, further comprising a flow limiter disposed upstream of the first and second valves.

3. The washing machine appliance of claim 1, wherein the second valve is positioned to provide water to the first compartment.

4. The washing machine appliance of claim 1, wherein the second valve is positioned to provide water to the second compartment.

5. The washing machine appliance of claim 1, further comprising a fluid additive dispenser and a valve manifold, wherein the fluid additive dispenser comprises the first compartment, the second compartment, and the third opening, and wherein the valve manifold comprises the first valve and the second valve.

6. The washing machine appliance of claim 5, further comprising a flow limiter disposed upstream of the first and second valves.

7. The washing machine appliance of claim 5, wherein the first outlet comprises a siphon.

8. The washing machine appliance of claim 5, wherein the second outlet comprises a siphon.

9. The washing machine appliance of claim 5, wherein the second valve is positioned to provide water to the first compartment of the fluid additive dispenser.

10. The washing machine appliance of claim 5, wherein the second valve is positioned to provide water to the second compartment of the fluid additive dispenser.

11. A washing machine appliance defining a vertical direction, the washing machine appliance comprising:

a cabinet;

a wash tub located within the cabinet;

a wash basket rotatably mounted within the wash tub;

a first compartment configured for the receipt of a fluid additive, the first compartment having a planar first wall portion extending along the vertical direction from a bottom of the first compartment, a first opening defined in the first wall portion to provide fluid to the wash basket, the first opening defined at a vertical height $h_1$ from the bottom of the first compartment, and a first outlet defined in the bottom of the first compartment to provide fluid to the wash basket;

a second compartment configured for the receipt of a fluid additive, the second compartment adjacent the first compartment, the second compartment having a planar second wall portion extending along the vertical direction from a bottom of the second compartment, a second opening defined in the second wall portion to provide fluid to the wash basket, the second opening defined at a vertical height $h_2$ from the bottom of the second compartment, and a second outlet defined in the bottom of the second compartment to provide fluid to the wash basket, a first valve configured to provide water to the wash basket; and a second valve configured to provide water to the first and second compartments, wherein the first compartment and the second compartment have a planar common wall portion extending along the vertical direction and defining a third opening to allow fluid communication between the first compartment and the second compartment, wherein the bottom of the first compartment and the bottom of the second compartment are vertically aligned such that the third opening is defined at a vertical height $h_3$ from the bottom of each of the first compartment and the second compartment, the vertical height $h_3$ being greater than the vertical height $h_1$ and the vertical height $h_3$ being greater than the vertical height $h_2$.

* * * * *